US006837761B2

(12) United States Patent
Saito

(10) Patent No.: US 6,837,761 B2
(45) Date of Patent: Jan. 4, 2005

(54) TILT DEVICE FOR OUTBOARD DRIVE

(75) Inventor: Hideki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 10/248,645

(22) Filed: Feb. 4, 2003

(65) Prior Publication Data

US 2003/0157848 A1 Aug. 21, 2003

(30) Foreign Application Priority Data

Feb. 18, 2002 (JP) ..... 2002-039890

(51) Int. Cl.[7] ..... B63H 5/125
(52) U.S. Cl. ..... 440/61 T; 440/61 D

(58) Field of Search ..... 440/61 T, 61 D, 440/61 H, 61 J, 900, 53

(56) References Cited

U.S. PATENT DOCUMENTS 5,032,094 A * 7/1991 Katogi ..... 440/61 R
5,049,099 A * 9/1991 Ito et al. ..... 440/61 R
6,139,380 A * 10/2000 Uematsu ..... 440/61 D

* cited by examiner

*Primary Examiner*—Ed Swinehart
(74) *Attorney, Agent, or Firm*—Ernest A. Beutler

(57) ABSTRACT

Two embodiments of tilt mounting attachments for mounting outboard drives on the transom of a watercraft. In each embodiment, the structure is simplified from the prior art and the number of components reduced. Thus, the unit can be made lighter in weight without sacrificing strength and the cost of assembly is substantially reduced.

6 Claims, 6 Drawing Sheets

TILT DEVICE FOR OUTBOARD DRIVE

BACKGROUND OF INVENTION

This invention relates to a tilt device for an outboard drive and more particularly to an improved arrangement for attaching an outboard drive such as the outboard motor or the outboard drive section of an inboard/outboard drive to the hull of an associated watercraft.

Normally outboard drives and specifically the attachment thereof to the transom of an associated watercraft are comprised of a number of components that are connected together by fasteners. Generally, these elements comprise a pair of clamping brackets that are affixed to the transom and define pivot axes for a tilt shaft. This tilt shaft is provided to journal the swivel bracket of the outboard drive for pivotal movement to the hull so that the trim angle of the outboard drive can be adjusted and also so that the outboard drive can be titled up out of the water.

These clamping brackets are affixed to a separate member that is comprised of a cylinder holding member. This cylinder holding member provides a mounting for a tilt cylinder assembly which is pivotally connected at one end to the cylinder holding member. The piston rod of this tilt cylinder is pivotally connected to the swivel bracket so that when the tilt cylinder is operated, the swivel bracket will be tilted up to raise the propulsion unit of the outboard drive out of the water.

In addition, a pair of trim cylinders is provided which are normally disposed on opposite sides of the tilt cylinder and which have piston rods that engage the swivel bracket to adjust the trim position during the operation. This adjustment is normally in the range of about twenty degrees (20°) while the tilt movement is much greater, such as about seventy degrees (70°).

The cylinder holding member also mounts a reversible electric motor and hydraulic pump as well as the hydraulic circuitry for operating the tilt cylinder and trim cylinder.

In addition to all of these functions, the tilt device further includes a pair of spaced apart abutments normally formed on the clamping brackets that engage opposite sides of the swivel bracket of the outboard drive so as to guide its movement when trimmed and tilted and also to take side thrusts. Hence, the components experience high loads and because they are formed by a number of separate pieces, each piece becomes rather heavy and complicated in addition, time is required to assemble these components and basically the weight becomes quite excessive and the cost is increased.

The type of prior art construction described may be best understood by reference to FIG. 1 which is a perspective view taken from the rear of a conventional prior art type of a tilt device for an outboard drive. The tilt device assembly is indicated generally by the reference numeral 11.

This assembly is comprised of a pair of transversely spaced apart clamping brackets, indicated generally by the reference numeral 12, each of which has a flange portion 13 that is adapted to be abuttingly engaged with a watercraft hull and primarily the transom thereof. These portions 13 are provided with a series of vertically spaced apertures 14 and a lower vertically extending aperture 15 that are adapted to receive threaded fasteners for fixing the clamping brackets 12 to the watercraft hull.

Extending rearwardly from these flanges 13 are wing-like portions 16, the upper ends of which define trunions or bearings 17 that are adapted to receive a tilt pin which, in turn, pivotally supports the swivel bracket of the outboard drive.

Affixed to these clamping brackets 12 is a cylinder holding member, indicated generally by the reference numeral 18. This cylinder holding member 18 is an assembly that provides at the lower end thereof a pivotal support for a trunion 19 of a tilt cylinder, indicated generally by the reference numeral 21. This tilt cylinder 21 is a hydraulically operated device and has an outwardly extending piston rod 22 that has a trunion 23 at its upper end for providing a pivotal connection to the swivel bracket of the outboard drive. When the piston rod is extended from the position shown in FIG. 1, the outboard drive will be tilted up to an out-of the water position.

In addition, a pair of trim cylinders, each of which is indicated generally by the reference numeral 24 is supported on opposite sides of the tilt cylinder 21 by the cylinder holding member 18. These trim cylinders are received in cylindrical bosses 25 formed in the cylinder holding member 18. Each trim cylinder 24 has a trim piston 26 that is abuttingly engaged with the swivel bracket for adjusting the trim position thereof.

Mounted on the cylinder holding member 18 also is the hydraulic control system and operating system for tilt cylinder 21 and trim cylinders 24. This includes a reversible electric motor 27 that drives a reversible hydraulic pump that receives fluid from a fluid reservoir 28. Fluid is circulated to the trim cylinder 24 and tilt cylinder 21 through suitable hydraulic circuitry which may include external conduits 29 and 31 as well as conduits formed internally in the assemblage.

The cylinder holding member 18 is affixed to the clamping brackets 12 by a plurality of threaded fasteners 32 which, in the illustrated prior art embodiment, are comprised of four at each side.

In order to hold the swivel bracket of the outboard drive against traverse movement during its tilt and trim operation, the clamping brackets are formed with abutment or guide surfaces 33 which embrace opposite sides of the swivel bracket and which hold it. Since the loads encountered are quite high, the entire assemblage tends to become heavy and is made by a number of castings which must be fixed to each other and thus, because of the separate assemblage, each component must be relatively heavy and the overall construction and its assemblage becomes bulky, heavy and expensive.

It is, therefore, a principal object to this invention to provide an improved and simplified tilt device for a marine outboard drive.

It is a further object to this invention to provide an improved tilt device for a marine outboard drive that is simple and lightweight in construction and nevertheless able to absorb the large loads that are placed upon it.

SUMMARY OF INVENTION

A first feature of the invention is adapted to be embodied in a tilt arrangement for a marine outboard drive. The tilting arrangement is comprised of interconnected cylinder holding, swivel bracket journaling, and transom attaching members. The cylinder holding member is adapted to receive and support a hydraulic cylinder assembly and the fluid arrangement for operating the hydraulic cylinder assembly. The swivel bracket journaling member is adapted to pivotally support a swivel bracket of the marine outboard drive. The transom attaching member is adapted to be affixed to the hull of an associated watercraft. The cylinder holding member is integrally formed with at least one of the other members.

Another feature of the invention is also adapted to be embodied in a tilt arrangement for a marine outboard drive comprised of interconnected cylinder holding, swivel bracket journaling, and transom attaching members. The cylinder holding member is adapted to receive and support a hydraulic cylinder assembly and the fluid arrangement for operating the hydraulic cylinder assembly. The swivel bracket journaling member is adapted to pivotally support a swivel bracket of the marine outboard drive. The transom attaching member is adapted to be affixed to the hull of an associated watercraft. The cylinder holding member provides a pair of integral abutments for restraining transverse movement of the swivel bracket while permitting its pivotal movement.

Still another feature of the invention is adapted to be embodied in a tilt arrangement for a marine outboard drive comprised of interconnected cylinder holding, swivel bracket journaling members. The cylinder holding member is adapted to receive and support a hydraulic cylinder assembly and the fluid arrangement for operating the hydraulic cylinder assembly. The swivel bracket journaling member is adapted to pivotally support a swivel bracket of the marine outboard drive. The transom attaching member is adapted to be affixed to the hull of an associated watercraft, the cylinder holding member providing an integral portion for affixing the tilt arrangement to the hull of an associated watercraft.

DETAILED DESCRIPTION

Figure 1:
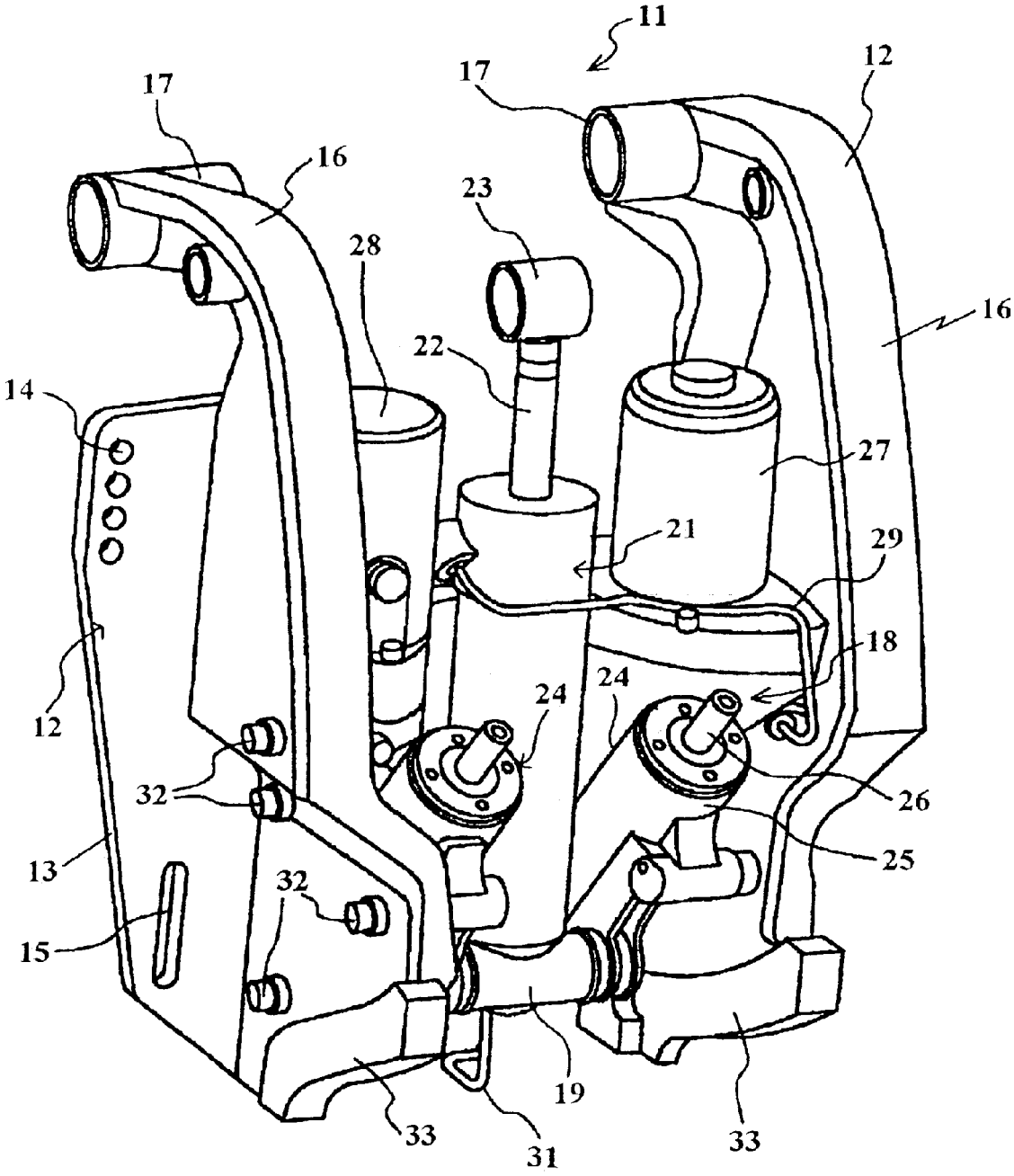
FIG. 1 Prior Art
FIG. 1 is a perspective view of a prior art type of tilt device for a marine outboard drive.
Figure 2:
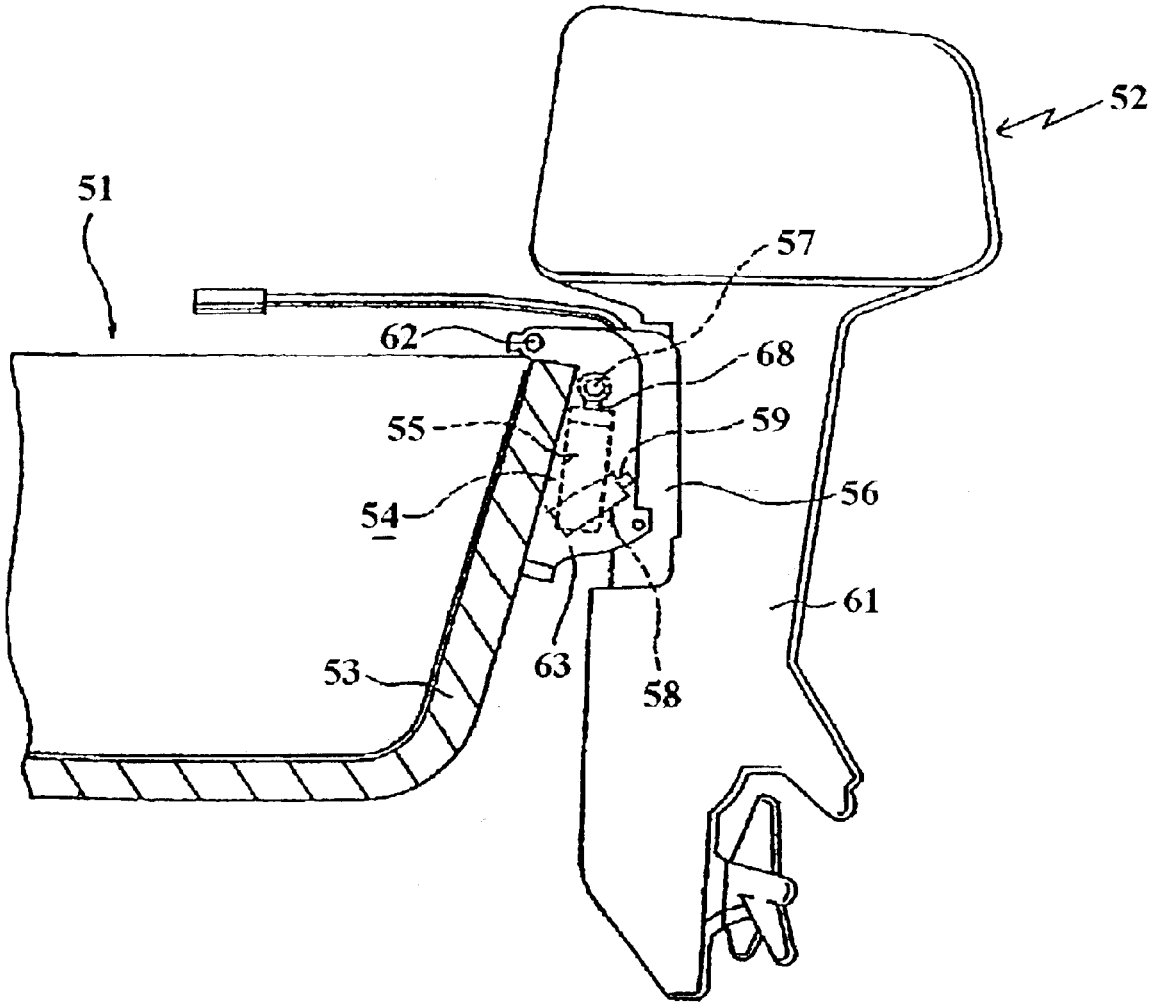
FIG. 2 is a side elevational view of a marine outboard drive and attaching structure constructed in accordance with the invention and is shown as attached to the transom of an associated watercraft, which is shown partially and in cross section.

Referring now in detail to the drawings and initially to FIG. 2, this figure illustrates the general environment in which the invention is adapted to be embodied. In this figure, a watercraft, indicated generally by the reference numeral 51, is shown partially and in cross section. The watercraft 51 is propelled by a marine outboard drive, indicated generally by the reference numeral 52 and in the specific construction illustrated, comprises an outboard motor.

The outboard motor 52 is affixed to a transom 53 of the watercraft 51 by a tilt attaching device, indicated generally by the reference numeral 54. This tilt attaching device 54 can be of a specific form, as will be described later, and includes a tilt cylinder 55 having a pivotal connection to a swivel bracket 56 of the outboard motor 52 by means of a tilt pin 57.

In addition, a pair of trim cylinders 58 are carried by the attaching device 54 and have trim pistons 59 abuttingly engaged with the swivel bracket 56 so as to control the trim position. This tilt and trim movement of the outboard motor 52 and specifically its drive shaft housing 61 occurs about a trim and tilt pivot axis 62 provided in the manner to be described. The attaching device 54 includes a main body assembly, indicated generally by the reference numeral 63.

Figure 3:
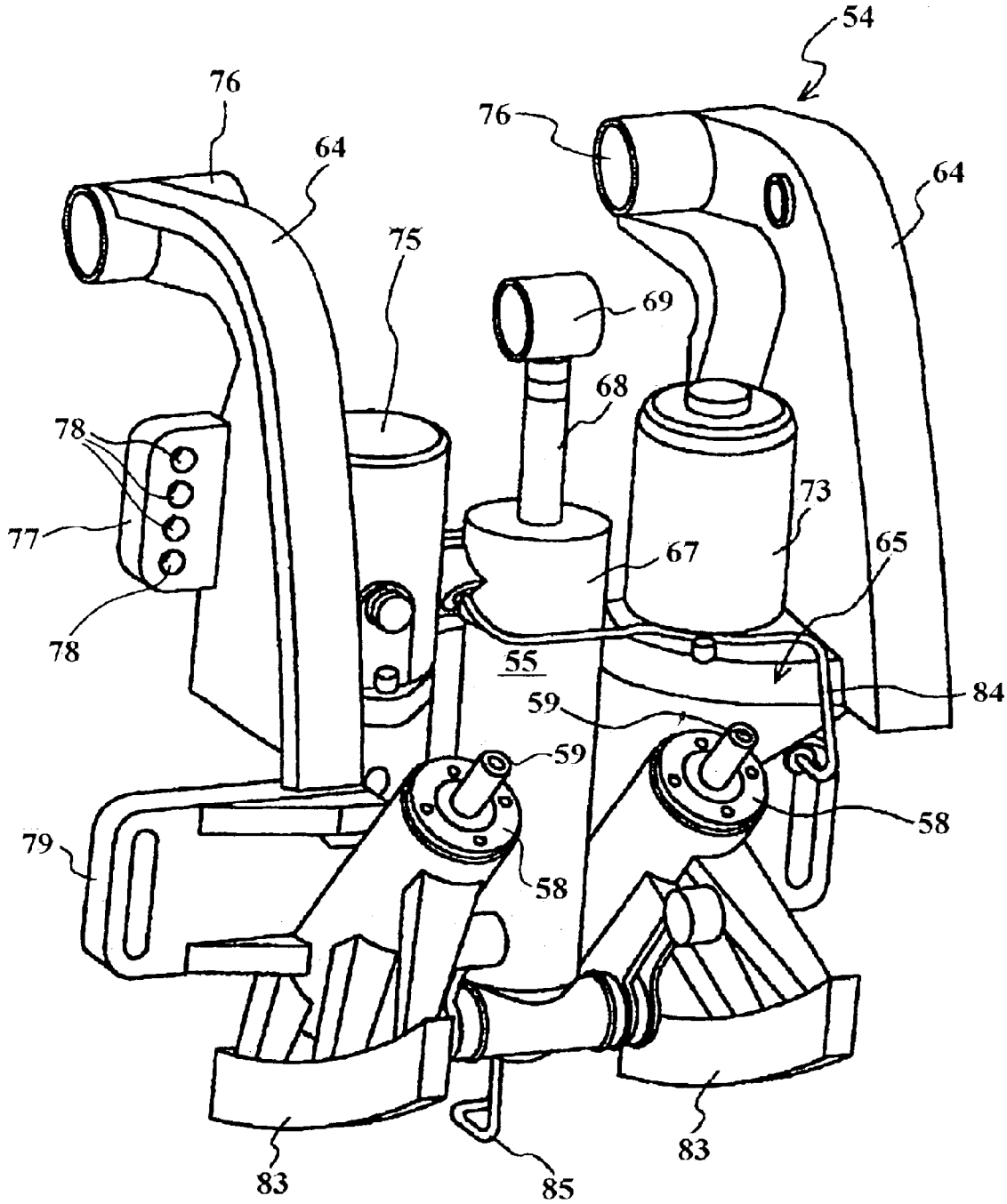
FIG. 3 is a perspective view, in part similar to FIG. 1, showing a first embodiment of the invention.
Figure 4:
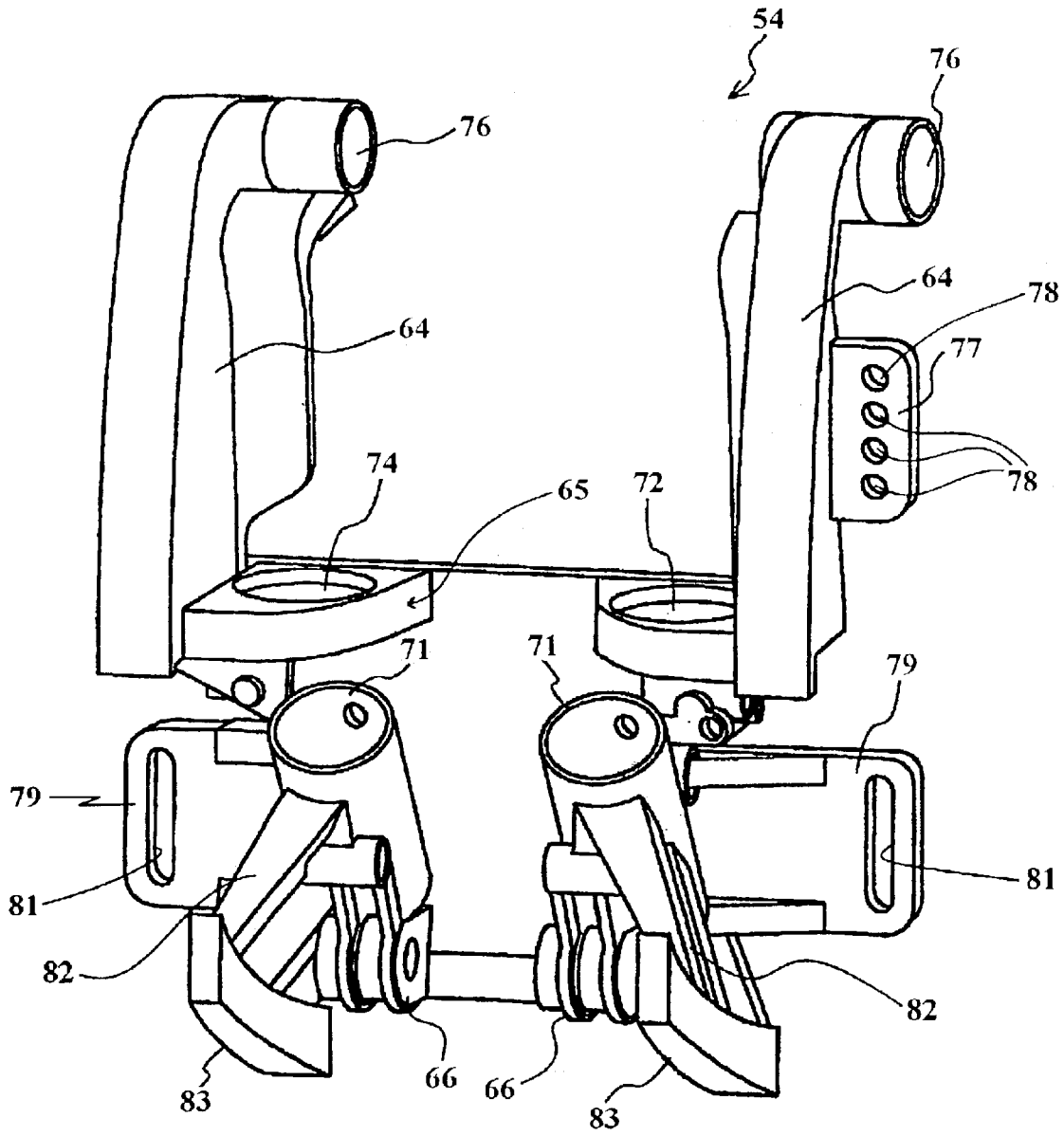
FIG. 4 is a perspective view looking from the opposite side of FIG. 3 and shows the unit with the components removed.

Referring now in detail to a first embodiment as shown in FIGS. 3 and 4, the tilt attaching device 54 is comprised of a unitary assembly that consists of a pair of side clamping bracket portions 64 which are integrally connected to a cylinder mounting portion that is comprised, in this embodiment, of a intermediate or middle body assembly 65.

The cylinder mounting assembly 65 has a pair of trunion portions 66 formed integrally at the lower end thereof and which are adapted to receive the cylinder 67 of the tilt cylinder 55. This tilt cylinder 55 has supported within its body a piston rod 68 that carries a trunion 69 at its upper end that received the tilt pivot pin 57 for connection to the swivel bracket 56.

In addition, the cylinder mounting portion defines a pair of integral trim cylinder receiving bores 71 in which the trim cylinders 58 are received. The cylinder mounting portion 65 further includes a first boss-like recess 72 that is adapted to receive the electric motor 73 and reversible hydraulic pump driven thereby. In addition, a second recess 74 contains and supports a fluid reservoir 75. The member 54 is formed with suitable internal passageways so as to deliver fluid to cylinder 67 and 58 and return it to the reservoir 75. In addition, external components may also be provided as will be described latter.

The clamping bracket portion 64 defines trunions 76 at their upper ends which receive the tilt pin 72 for pivotal support of the swivel bracket 56 which is not shown in FIGS. 3 and 4 but which does appear in FIG. 2. In addition, the clamping brackets 64 have outwardly extending flanges 77 in which a series of apertures 78 are formed so that to receive fasteners so as to provide attachment to the transom 53. The trim cylinder mounting portion 71 also have outstanding flanges 79 which define vertically extending slots 81 so to accommodate further fasteners for attachment to the transom 73.

Finally, the trim cylinder mounting portion 71 have extending parts 82 which at their extremity define abutment surfaces 83 for engaging and holding the opposite sides of the swivel bracket 56 to take its side thrusts and prevent movement. FIG. 3 also shows at 84 and 85 the external conduits for fluid connections.

Therefore, it should be readily apparent that this embodiment provides a simplified unitary assembly that can be quite strong and light in weight. In addition, since the main components are all integrally formed together, no fastening assembly operation is required and the device is quite lightweight and low in costs without sacrificing strength.

Figure 5:
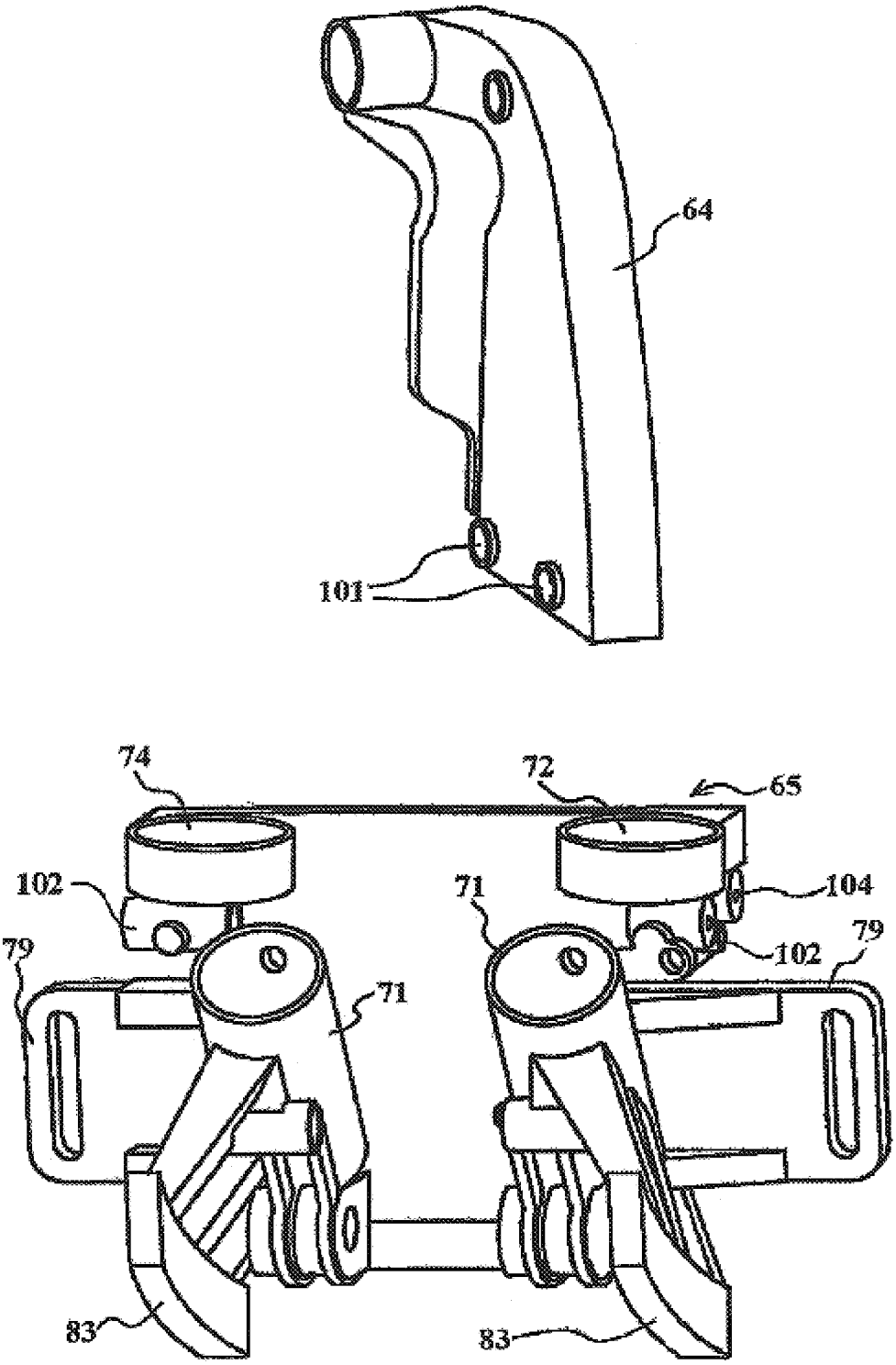
FIG. 5 is a perspective view, in part similar to FIG. 4, but shows another embodiment of the invention.
Figure 6:
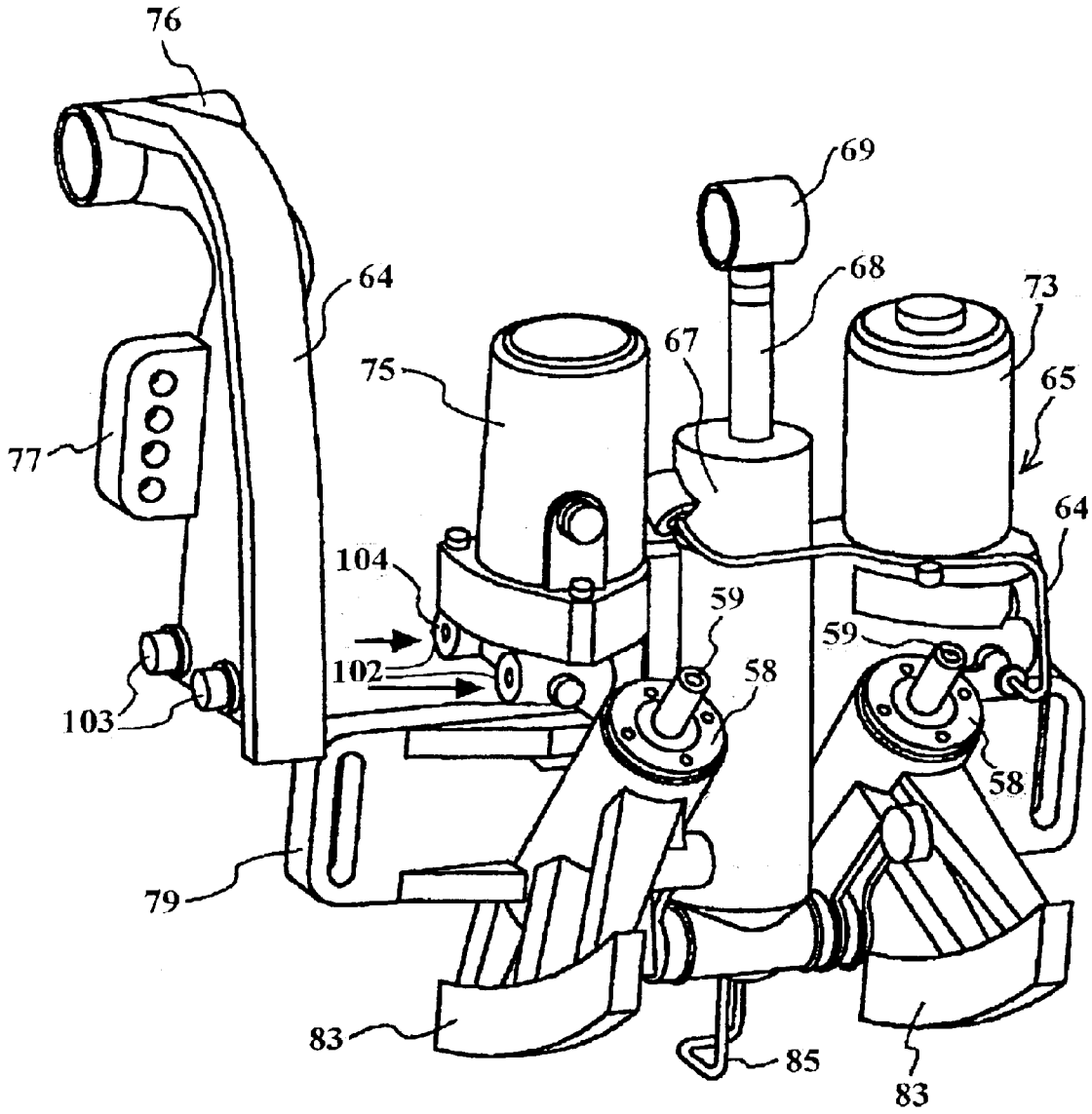
FIG. 6 is a perspective view of this embodiment, looking in the same direction as FIG. 3 and shows how the components are assembled together.

FIGS. 5 and 6 show another embodiment which is basically the same as the embodiment shown in FIGS. 2 through 4. Where the components in this embodiment are the same or substantially the same as those previously illustrated and described, they are identified by the same reference numerals.

In this embodiment, the clamping bracket portions 64 are formed as separate units from the cylinder mounting portion 65. To this end, each of the clamping bracket portions 64 is provided with a pair of fastener receiving openings 110 at their lower end which are aligned with bosses 102 formed on opposite sides of the cylinder mounting portion 65. Threaded fasteners 103 are passed through these openings 101 and threaded into tapped openings 104 formed in the bosses 102 so as to provide the connection between the members. Thus, like the preceding embodiment, this embodiment has the advantage of simplicity and greater unity of construction than the prior art to provide lightweight and low cost mounting of the outboard drive to the associated watercraft.

It should be readily apparent that the foregoing description describes two preferred embodiments of the invention that provide very effective, lightweight, low costs and easily manufactured outboard drive trim mounting attachments. Of course, the embodiments illustrated and described are preferred embodiments and various changes and modifications may be made without departing from the spirit and scope of the invention, as defined by the appended claims.

What is claimed is:

1. A tilt arrangement for a marine outboard drive comprised of interconnected cylinder holding, swivel bracket journaling, and transom attaching members, said cylinder holding member being adapted to receive and support a hydraulic cylinder assembly and the fluid arrangement for operating the hydraulic cylinder assembly, said swivel bracket journaling member being adapted to pivotally support a swivel bracket of the marine outboard drive, said transom attaching member being adapted to be affixed to the hull of an associated watercraft, said cylinder holding member being formed as a nondetacheable unit with at least one of the other members.

2. A tilt arrangement for a marine outboard drive as set forth in claim 1 wherein one of the members also provides an abutment spaced from the swivel bracket journal for restraining transverse movement of the swivel bracket.

3. A tilt arrangement for a marine outboard drive as set forth in claim 2 wherein the member that provides an abutment spaced from the swivel bracket journal for restraining transverse movement of the swivel bracket comprises the cylinder holding member.

4. A tilt arrangement for a marine outboard drive as set forth in claim 1 wherein all of the members are nondetachably connected with each other.

5. A tilt arrangement for a marine outboard drive comprised of interconnected cylinder holding, swivel bracket journaling, and transom attaching members, said cylinder holding member being adapted to receive and support a hydraulic cylinder assembly and the fluid arrangement for operating the hydraulic cylinder assembly, said swivel bracket journaling member being adapted to pivotally support a swivel bracket of the marine outboard drive, said transom attaching member being adapted to be affixed to the hull of an associated watercraft, said cylinder holding member providing a pair of nondetachably connected abutments for restraining transverse movement of the swivel bracket while permitting its pivotal movement.

6. A tilt arrangement for a marine outboard drive comprised of interconnected cylinder holding, swivel bracket journaling members, said cylinder holding member being adapted to receive and support a hydraulic cylinder assembly and the fluid arrangement for operating the hydraulic cylinder assembly, said swivel bracket journaling member being adapted to pivotally support a swivel bracket of the marine outboard drive, said transom attaching member being adapted to be affixed to the hull of an associated watercraft, said cylinder holding member providing an nondetachably connected portion for affixing said tilt arrangement to the hull of an associated watercraft.

* * * * *